United States Patent [19]

Ayers et al.

[11] Patent Number: 4,619,845

[45] Date of Patent: Oct. 28, 1986

[54] METHOD FOR GENERATING FINE SPRAYS OF MOLTEN METAL FOR SPRAY COATING AND POWDER MAKING

[75] Inventors: Jack D. Ayers, Oakton; Iver E. Anderson, Alexandria, both of Va.

[73] Assignee: The United States of America as represented by the Secretary of the Navy, Washington, D.C.

[21] Appl. No.: 704,117

[22] Filed: Feb. 22, 1985

[51] Int. Cl.[4] ..... B05D 1/02

[52] U.S. Cl. ..... 427/422; 239/79; 239/8; 239/13

[58] Field of Search ..... 239/82, 122, 79, 85, 239/8, 13; 427/422; 264/12; 164/46

[56] References Cited

U.S. PATENT DOCUMENTS

| | | | |
|---|---|---|---|
| 3,093,315 | 6/1963 | Tachiki et al. | 264/12 X |
| 3,663,206 | 5/1972 | Lubanska | 264/12 X |
| 4,066,117 | 1/1978 | Clark et al. | 427/422 X |

FOREIGN PATENT DOCUMENTS

| | | | |
|---|---|---|---|
| 722588 | 3/1980 | U.S.S.R. | 239/82 |

*Primary Examiner*—Shrive P. Beck

*Attorney, Agent, or Firm*—Robert F. Beers; Sol Sheinbein; Edward V. Hiskes

[57] ABSTRACT

A method for generating fine sprays of molten metal for spray coating and powder making is disclosed. Liquid metal is fed via a melt tube to a nozzle that is shaped like the frustrum of a cone. The nozzle is surrounded with gas jets in a coaxial pattern around the melt tube orifice. High pressure gas causes the formation of a low pressure region immediately next to the melt tube orifice that draws metal out of the orifice at a higher rate than would otherwise be the case. The coaxial gas stream atomizes the metal into droplets and thereafter forms a narrow, supersonic spray containing very fine metal droplets suitable for powder making or application of a coating.

10 Claims, 15 Drawing Figures

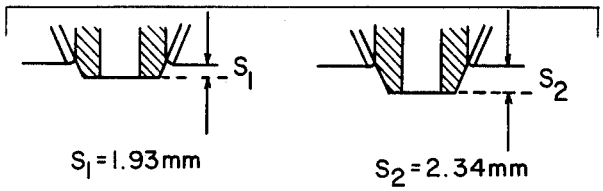
FIG. 4(a)
FIG. 4(b)
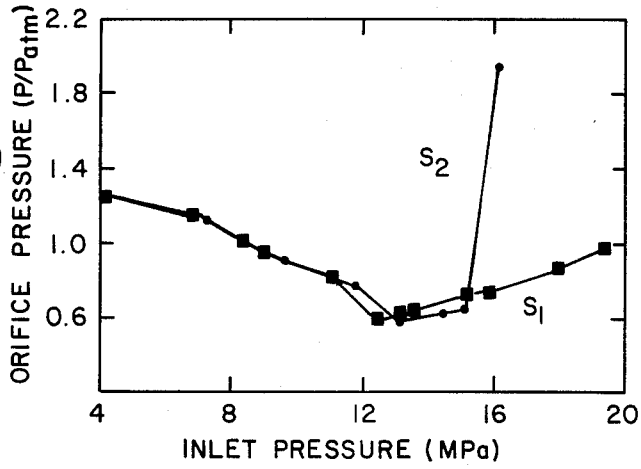
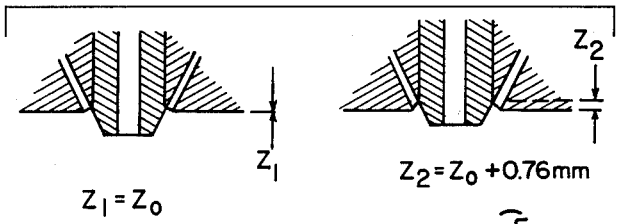
FIG. 5(a)
FIG. 5(a)
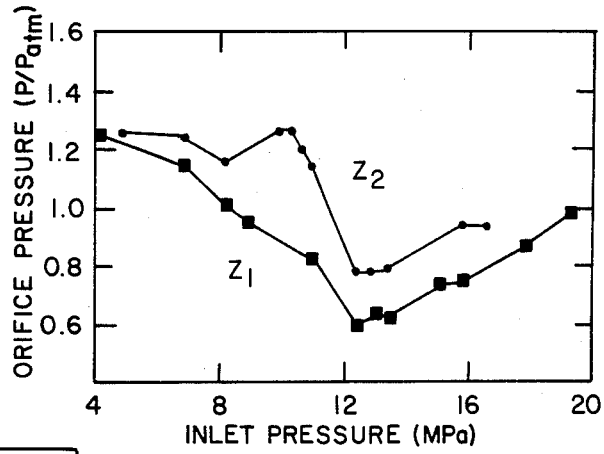
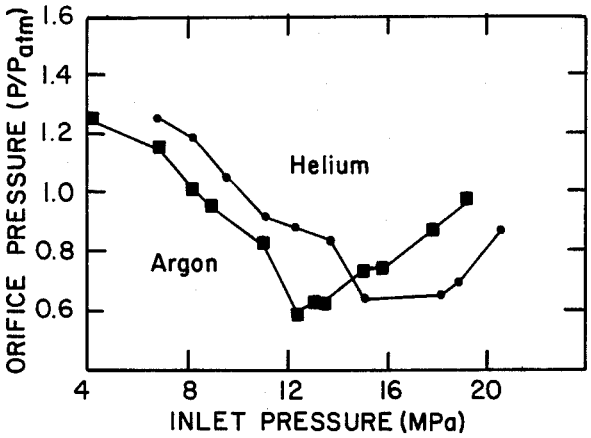
FIG. 6

METHOD FOR GENERATING FINE SPRAYS OF MOLTEN METAL FOR SPRAY COATING AND POWDER MAKING

BACKGROUND OF THE INVENTION

This invention relates in general to means for spray deposition of dense coatings of molten metal to surfaces and in particular to means for applying coatings of metal from sprays of fine metal droplets that are derived directly from a melt, which are sprayable in a cool supersonic gas stream of narrow width, and which are rapidly cooled without impacting a surface if metal powder is desired.

PRIOR ART

Several methods of metal coating involving finely divided droplets of molten metal being deposited upon a surface exist in the prior art. These include the thermal processes, wherein heat is applied to wire-form or powdered metal immediately prior to deposition, and the gas atomization processes, wherein high pressure jets of an inert gas are caused to impinge upon a stream of molten metal.

In the thermal deposition method known as plasma spraying, powdered metal is fed into a powerful plasma arc maintained in a nozzle. The arc rapidly expands the ambient gas in the nozzle, melts the metal and sprays it in a hot plume of gas toward a substrate. The spray often attains supersonic speeds, and, consequently, is of narrow width. Supersonic sprays typically form cones with angular divergences on the order of 12 to 15 degrees. The supersonic spray angle obtainable with thermal spraying technique is desirable, but the elevated temperature of the gas jet is not. A hot jet gas causes substrate and deposited metal heating that can gave detrimental impacts upon the properties of the product. In addition, powdered metal starting material costs more than a simple melt.

In contrast, a gas atomization process allows the use of economical molten metal as the starting material. A typical example of gas atomization is taught in U.S. Pat. No. 4,064,295. The process is generally carried out by allowing high pressure jets of an inert gas to impinge coaxially upon a stream of molten metal. The jets are pointed so that the gas contacts the metal stream at an obtuse angle and so that the direction of the gas flow is nearly the same as the direction of the flow of molten metal from the tube coming from the melt. This scheme allows molten metal exiting the melt crucible through the tube to be atomized immediately by the coaxial gas jets as it exits from the tube. The flow from a plurality of jets forms a unified gas stream which bears the atomized particles toward the substrate to be coated. However, this gas stream heretofore has been of subsonic speed, and therefore, spread out at a large angle after atomizing the metal melt. The wide spread of the gas stream meant that it was not helpful in cooling the substrate and that it was not effective in directing the atomized metal toward small targets.

There is much discussion in the prior art regarding what should be the gas input pressure to the coaxial gas jets in order to achieve the best metal atomization and gas stream properties. On the one hand, higher gas pressure means that more energy is available for metal atomization. On the other hand, high gas pressure causes various problems depending upon exactly how high the pressure is made: (1) as gas delivery pressure is increased, positive orifice pressure conditions come to exist at the point where the metal exits the tube from the melt, just before entering the coaxial gas stream. This positive pressure at the melt orifice can cause backstreaming, i.e., allow carrier gas to bubble up through the metal tube into the melt crucible, thus causing hazardous gas eruptions in the melt and unstable metal delivery rates to the atomizer. (2) If gas delivery pressure is increased still further the orifice pressure begins to drop, resulting at very high pressures in an aspiration effect which sometimes forms a vacuum at the point where the metal exits the tube from the melt. This vacuum may be referred to as the aspiration vacuum. According to prior art reasoning, this aspiration vacuum causes excessive delivery of metal to the atomizer gas jets, and therefore, unduly large particle size. The present invention demonstrates that this reasoning is not correct.

The most widely adapted solution to the problems described above was to simply cease increasing pressure before backstreaming pressure became sufficiently high to cause bubbling of gas in the melt crucible. With nozzles of form similar to that disclosed by the present inventors, the maximum inlet pressure before the onset of bubbling is in the range of 500 psig.

Another prior art solution to the problem of selecting the proper pressure for gas jet operation was to select a "critical point" pressure where the aspiration vacuum of problem (2) balanced the positive backstreaming pressure of problem (1). This solution is proposed by M. J. Cooper and R. F. Singer in "Rapidly Solidified Aluminum Alloy Powder Produced by Optimization of the Gas Atomization Technique", distributed at the Conference on Rapidly Quenched Metal, Wurtzberg, Germany, 3–7 Sept. 1984. The "critical point" occurs at inlet pressures in the range of 900–1200 psig with typical nozzle designs. The shortcoming of this prior art solution to the problem as applied to spray coating, overcome by the present invention, is that it results in a wide-pattern, subsonic spray that does not efficiently direct cooling to a small area of the substrate.

SUMMARY OF THE INVENTION

Accordingly, one object of the current invention is to apply atomized metals to a substrate using a stream of carrier gas that is supersonic well beyond the point where the metal is atomized.

Another object of the invention is to generate a very narrow stream of carrier gas so that the atomized metal is deposited in a tight pattern and so that the stream of carrier gas impacts exactly where needed to cool the substrate.

Another object of the invention is to cool liquid metal deposited upon a substrate at an extremely high rate by causing a narrow, intense jet of cool gas to be directed upon the point where the liquid metal is being deposited.

Another object is to atomize metals directly from a melt to particle sizes of 10 microns and below.

Another object of the invention is to overcome both the backstreaming and aspiration pressure problems perceived in the prior art while simultaneously achieving a narrow-pattern metal spray and a cooling gas stream.

These and other objects of the invention are achieved in a method and apparatus for generating fine sprays of molten metal by increasing the inlet pressure to the coaxial gas jets to a value approximately twice that taught by the prior art and by optimizing the melt tube tip design and placement to facilitate laminar flow of the gas to the atomization zone. As gas jet pressure is increased past the "critical point", described above, the aspiration vacuum will become more perfect, i.e., the pressure will decrease to a minimum. This is the aspiration minimum point. If the gas jet pressure is increased beyond the aspiration minimum point, the aspiration vacuum will become less perfect, i.e., the pressure at the melt tube orifice will begin to rise. According to the teachings of the present invention, if the pressure at the melt tube orifice is set at the aspiration minimum point, the result is a supersonic flow of carrier gas that is directed in a very narrow cone, and which contains very finely atomized metal. The supersonic nature and increased energy of the very high pressure gas stream allows atomization to occur with unexpectedly high efficiency even with the accelerated metal flow rates caused by the aspiration vacuum.

BRIEF DESCRIPTION OF THE DRAWINGS

A more complete appreciation of the invention and many of its attendant advantages will be readily obtained by reference to the following detailed description when considered in connection with the accompanying drawings, wherein:

FIG. 3(*b*) is a graph summarizing test results of gas inlet pressure versus metal outlet tube orifice pressure for the configurations shown in FIG. 3(*a*).

FIG. 4(*a*) is a schematic diagram illustrating preferable and non-preferable lengths of the melt nozzle.

FIG. 4(*b*) is a graph summarizing test results of gas inlet pressure versus metal outlet tube orifice pressure for the configurations shown in FIG. 4(*a*).

FIG. 5(*a*) is a schematic diagram illustrating preferable and non-preferable positioning of the ends of the gas jets with respect to the tip of the melt nozzle.

FIG. 5(*b*) is a graph which summarizes test results of gas inlet pressure versus metal outlet tube orifice pressure for the configurations shown in FIG. 5(*a*).

FIG. 6 is a graph which illustrates performance of the invention with either Ar or He as the carrier gas.

DETAILED DESCRIPTION OF THE PREFERRED EMBODIMENT

Figure 1:
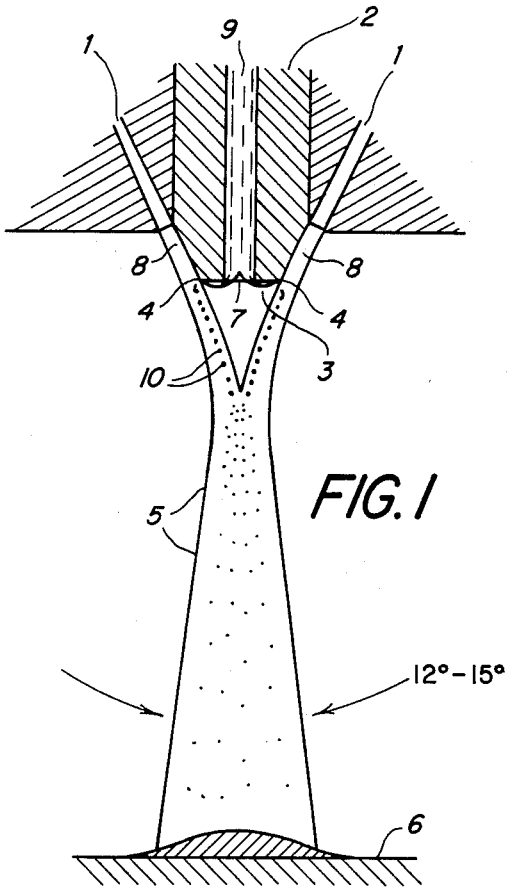
FIG. 1 is a schematic diagram of one embodiment of the present invention [the device of FIG. 1 in operation with gas flowing out of coaxial jet 1; and metal flowing from metal output nozzle 2 to form a film of metal 3 at the end of the nozzle; from which droplet at point 4 particles of molten metal are sheared and carried by gas stream 5 to substrate 6.]

Referring to FIG. 1, the apparatus and method for achieving a supersonic spray of atomized metal is illustrated. Liquid metal is conveyed by overpressure, gravity or by the aspiration pressure from a melt furnace (not shown) down metal output nozzle 2 to the nozzle opening 7. Due to surface tension the stream 9 liquid metal forms a film 3 is drawn toward apex points 4 on the nozzle tip. Here, the liquid metal is subjected to shearing force from cool, usually inert, carrier gas issuing from coaxial gas jets 1 and passing over angular nozzle surface 8 while traveling toward apex points 4. In the tested, preferred embodiment, eighten coaxial jets disposed around the outside of the melt tube orifice 2 were used so as to achieve a high degree of circular symmetry with respect to the axis of the gas stream. From apex points 4, atomized liquid metal particles 10 are borne into the supersonic gas/metal spray 5, and, may impact upon a substrate to be coated 6, placed in the path of the spray. The spray 5 is supersonic to a point well past the apex points 4 where atomization occurs.

Melt nozzle tube 2 conveys liquid metal from a melting furnace (not shown) to a melt orifice 5. A round, ceramic coated tube and nozzle opening were used in tests of this invention, but other shapes and construction materials may also be suitable. The nozzle orifice 7 may be ceramic, graphite, metal, or other material able to withstand the temperature of the particular molten metal in use. The material of which the nozzle is composed may be the same or different from that of the melt tube.

Gas jets 1 convey cool gas from the gas inlet (not shown) to the edge of angular surface 8. Preferably, the gas jets 1 should be positioned so that gas emitting from the jets flows directly on and parallel to surface 18. Details of test concerning this preference are presented with the discussion of FIG. 5, infra. However, if other parameters such as the angle contained by the apex points or the length of surface 8 are adjusted, it may be possible to obtain supersonic operation with gas jet positioning not directly on surface 8 or not parallel to it. This disclosure teaches that, by increasing the pressure from the coaxial gas jets, it is possible to enter a new regime of atomizer operation wherein a negative pressure appears at the metal tube orifice, and wherein a supersonic spray is generated. Knowing this, the person of ordinary skill in the art will be able to adjust the apex angle, gas jet positioning, and other aspect of nozzle geometry various ways in attempts to find other combinations of parameters that will also allow operation in the supersonic spray regime disclosed herein. If a particular nozzle geometry generates a reduced pressure at the melt tube orifice when operated at gas jet inlet pressures in the range of 1000 psig to 2000 psig, and if a supersonic spray cone is observed, then that nozzle geometry will be sufficient for practicing this invention.

The angle at which each gas jet 1 is oriented with respect to the surface of the melt nozzle case is important. Preferably, this angle is zero so that laminar, not tubulent, flow is present along the coaxial surface. Turbulent flow precludes the formation of a supersonic gas stream downstream from the atomization region. Given the other parameters of the tested embodiments of this invention, it is preferable that the cone formed by extending the lines of the coaxial gas jets have a central angle close to that of the cone angle in which the nozzle frustrum is inscribed, see FIG. 3(*a*). Experiments with nozzles identical except for the frustrum angle showed that a 45-degree gas jet angle with a 45° frustrum angle was operable in creating an aspiration minimum of less than one atmosphere, whereas a 45° degree gas jet angle with a 63° frustrum angle resulted in a nozzle wherein the magnitude of the positive backstreaming pressure always exceeded the magnitude of the negative aspiration pressure, see FIG. 4(*b*). Thus, the melt tube orifice pressure never decreased below 1 atm, and supersonic operation did not occur. However, if other parameters, such as apex 4 shape, gas jet positioning, and nozzle length are changed from what they were in the tested embodiments of this invention, mismatch of nozzle frustrum and gas jet angle may be tolerated, provided that the other parameters and adjusted in order to achieve non-turbulent, laminar, flow.

Figure 3A:
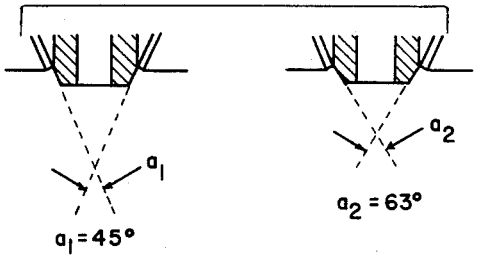
FIG. 3(*a*) is a schematic diagram illustrating preferable and non-preferable angular configurations of the melt tube tip.
Figure 3B:
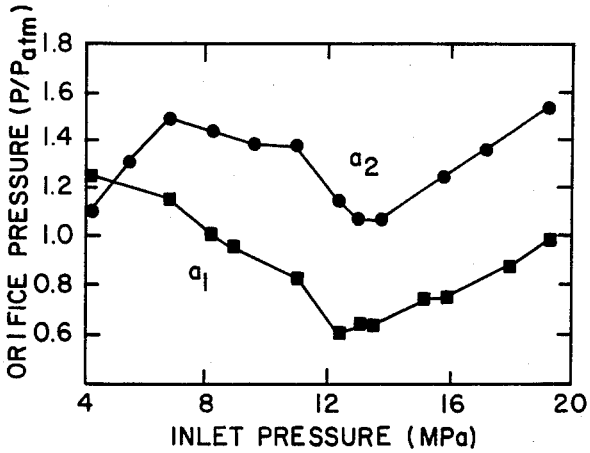
Figure 7A:
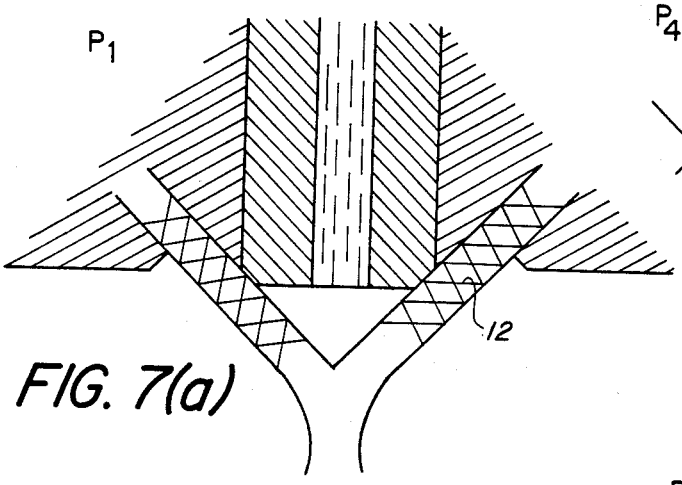
FIG. 7 is a schematic diagram of gas flow patterns showing how the gas jet outputs combine to form a supersonic spray.
Figure 7D:
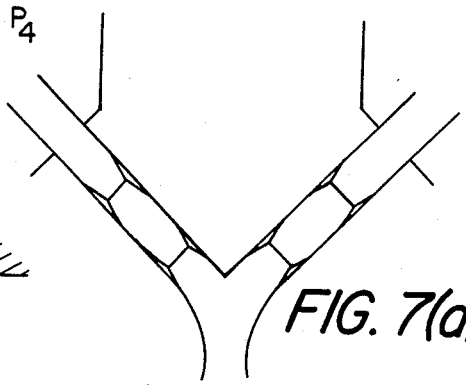
Figure 7B:
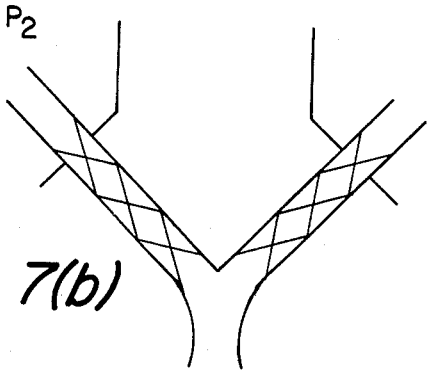
Figure 7E:
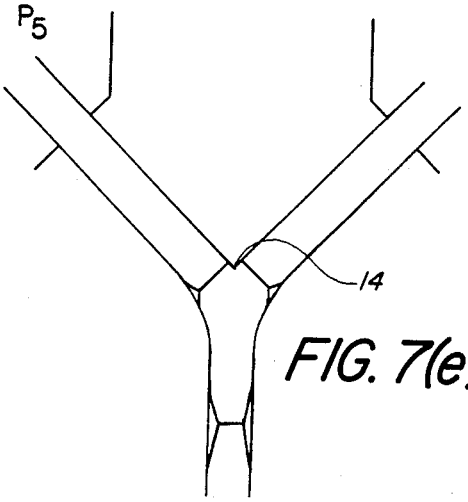
Figure 7C:
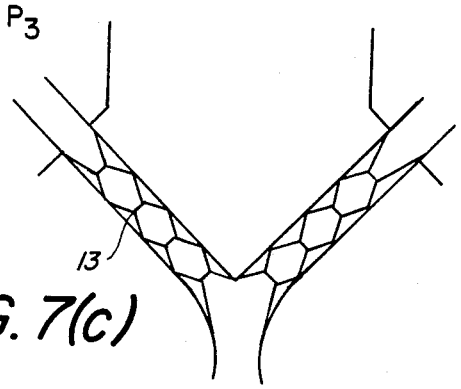
Figure 7F:
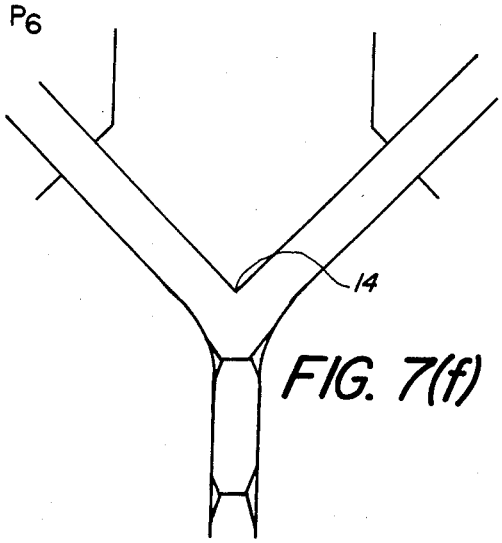

As is shown in FIG. 3(*b*), both the 45 degree frustrum angle and the 63 degree frustrum angle produced backstreaming when attempts were made to atomize a melt of Sn-5% Pb, using gas inlet pressures of 6.9 MPa (1000 psig). Measurement of pure gas pressure at the melt tube orifice while these frustrum angles were in use indicating that both produced backstreaming pressures in excess of 1 atmosphere, and that, therefore, improper operation was to be expected. However, with higher pressures, the nozzle with the 45 degree frustrum shifted into a mode that would cause metal to aspirate down the melt tube. FIG. 3 shows that the orifice pressure of the 45 degree tip actually drops to a minimum of 0.6 atm at 12.5 MPa (180 psig) gas input pressure. The tip displays a rising trend in orifice pressure back up to 1 atm as the inlet pressure is increased to about 19.3 MPa (2800 psig). An aspiration range of about 11 MPa is thus available from 8.3 MPa (1200 psig) to 19.3 MPa. It is in this range, most preferably at the 0.6 atm minimum, that supersonic stream operating conditions occur. In contrast, the tip with a mismatch between frustrum angle and gas jet angle failed to give any aspiration effect less than 1 atm over the entire inlet pressure range. The results indicate that turbulent flow can reduce or eliminate the aspiration capability of a melt nozzle. Thus, the preferable embodiment of this invention is designed so that laminar flow will take place from the gas jet output over the frustrum surface.

The effect of nozzle tip length or extention on aspiration response was studied using the tip designs shown in FIG. 4(*a*), with tip extention of 1.93 mm (0.076") and 2.34 mm (0.092") with a 45 degree taper angle. Both tip designs produced equivalent aspiration responses up to about 15.2 MPa (2200 psig). However, the orifice pressure of the longer tip climbed rapidly above 2 atm as the inlet presssure was increased. Thus, the longer tip suddenly produced backstreaming at very high inlet pressures. Accordingly, both the long and short tips are successful in producing a supersonic stream that can be used to practice this invention, but the shorter tip is the preferable embodiment due to its more stable operation.

The effect of a change in the tip placement with respect to the ends of the coaxial gas jets was studied using the designs shown in FIG. 5(*a*), which designs also have a 45 degree taper angle and tip length extension of 1.93 mm (0.0760). This study was meant to determine whether the coaxial gas jets should be arranged so that the gas jet should be flush against the inclined surface 12 of the nozzle or whether the gas jet should be detached from the 12 surface. The results presented in FIG. 5(*b*) indicate that, preferably, the gas jets should be flush with surface 18, in order to obtain the lowest aspiration pressure, and thus, the best supersonic operation. This again indicates that laminar flow wll result in better atomization and supersonic spray speeds.

FIG. 6 indicates that either Argon or Helium gas will operate in the preferred embodiment of this device. The optimum gas inlet pressure must be adjusted differently in order to achieve minimum aspiration pressure in each case, however.

Figure 2:
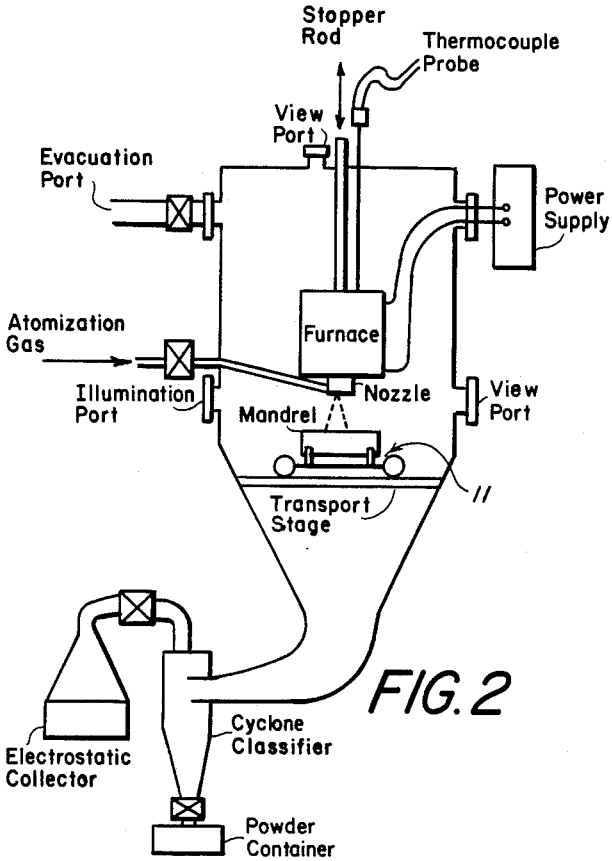
FIG. 2 is a schematic diagram of the device and method of this invention in the context of an entire system for depositing coating upon a substrate located upon a movable transport stage.

In cases where it is desired to apply a coating of liquid metal to a surface, the surface may be placed at the opposite end of the supersonic stream from the nozzle at a distance of from 10 to 50 centimeters. FIG. 2 illustrates how the substrate to be coated can be placed on transport stage 11 for coating over large areas. In cases where metal powder production is desired, the spray may be directed into a powder collection apparatus located at a distance form the nozzle sufficient to allow solidifying of the metal droplets prior to their impact upon a surface.

For a clearer understanding of the invention, two examples of it are given below: one example of powder making, and one example of spray coating. These examples are merely illustrative and are not to be understood as limiting the scope and underlying principles of the invention in any way.

EXAMPLE OF POWDER MAKING

A melt tip configured with a 45 degree taper, a 1.93 mm tip extension, and with the tip positioned flush with surface 8 was chosen. Ar gas was directed through the coaxial gas jets. Pressure of the Ar gas was increased while a pressure transducer at the output of the melt nozzle monitored melt orifice pressure. As gas inlet pressure was increased, the critical orifice pressure of 1 atm was observed. As inlet pressure continued to increase, orifice pressure dropped steadily until it reached a minimum value of 0.6 atm at an inlet pressure of 12.5 MPa (1800 psig). With these conditions a valve in the melt tube was opened and an alloy of tin-5% Pb, heated to 550 degrees centigrade, was allowed to flow through the nozzle and atomize. The atomized melt cooled before impact. Analysis indicated that the particles were primarily of spherical shape and that 75% of the particles obtained were of a diameter of 10 microns or less.

Two additional tests were performed under conditions identical to those above, except that the gas inlet pressures were 10.4 MPa (1500 psig) and 17.3 MPa (2500 psig), respectively. Both of these pressures resulted in orifice pressures of 0.85 atm and narrow supersonic streams.

Sn-5% Pb melt produced metal powder with volumetric mean diameter of 10 microns for the 1500 psig and 12 microns for the 2500 psig gas inlet pressures. The optimum 1800 psig pressure, described supra, produced a powder with 9 micron volumetric mean diameter.

EXAMPLE OF SPRAY COATING

A melt tip configured with a 45 degree taper, a 1.93 mm tip extension, and with the tip positioned flush with surface 12 was chosen. Ar gas at 1500 psig was directed through the coaxial gas jets. This produced an orifice pressure of 0.85 atm. A valve between the furnace and the melt tube was opened and an alloy of tin-5% Pb, heated to 550 degrees centigrade (330 degrees of superheat over liquidus temperature), was allowed to flow through the nozzle and to atomize the metal issuing from the nozzle. The atomized metal spray issuing from the nozzle impacted upon a copper wire suspended perpendicular to the axis of the nozzle and about 12 inches in front of it. A dense, parabolic buildup of spray deposit resulted. The deposit was 2¼ inches wide, indicating that the spray cone angle was 14 degrees.

TESTS FOR SOUND PULSE OPERATION

Standard schlierien photographic techniques were used to map gas density variations accompanying operation of the nozzles used in the foregoing examples. These tests indicated the absence of pressure or sound pulses in the combined gas jet flow when the nozzles were operating in the preferred pressure range. Stationary pressure fronts were observed.

PRINCIPLE OF SUPERSONIC NOZZLE OPERATION

FIG. 7 is a series of schematic diagrams illustrating how the principle of operation of this invention differs from that of prior art nozzles.

FIG. 7(*a*) is a schematic diagram illustrating gas jet nozzles 14 issuing streams of gas which flow over inclined nozzle frustrum exterior surfaces 8. The diamond pattern lines 12 shown within the gas streams define the volume within which gas flow is supersonic. Outside of this volume, the gas flow is substantially slower. The diamond pattern arises because a supersonic stream, when coming into contact with slower fluid, tends to be reflected.

FIG. 7(*b*) is a schematic diagram illustrating the effect of increased gas jet inlet pressure. The diamond pattern lines 12 are now extended in length due to the higher speed of the supersonic gas flow.

FIG. 7(*c*) is a schematic diagram illustrating a still further increase in pressure. As the diamond pattern are enlongated, they merged into one another. High pressure regions in the form of disks 13 come to exist periodically along the gas streams.

FIGS. 7(*d*) and 7(*e*) are schematic diagrams of the situation at yet higher pressures. The disk shaped shock fronts 13 enlarge and become farther and farther apart as pressure is increased in 7(*d*) and is yet higher in 7(*e*). In 7(*e*), the distance between disks is such that no disk 13 exists between the gas jet nozzle output and the focus point 14 at which the coaxial gas streams merge.

FIG. 7(*f*) is a schematic diagram illustrating a higher coaxial gas jet inlet pressure. It shows how the many coaxial gas jets have smoothly merged at focus point 14, and have thereafter formed a single, unified supersonic stream pattern.

The key to combining many coaxial gas jets into a stream that maintains supersonic properties, as in FIG. 7(*f*), downstream of focus point 14, is to eliminate all diamond pattern lines 12 upstream of the focus point. If diamond patterning in the stream exists at the focus point, severe reflection between the merging streams will cause a violent cloud of turbulence that will scatter gas and liquid metal particles borne by the gas in all directions. Much energy is dissipated in this process, and the stream can no longer remain at supersonic speed. This is why prior art sprays have a wide spray pattern.

However, if very high pressure is used to force all diamon patterning 20 and disk shock fronts 21 past the apex point 22, the streams do not mutually reflect from one another. Therefore, turbulence and energy losses are minimized, and the gas streams merge to form a single large stream with a single pattern of diamond-shaped pressure waves or disk shock fronts.

For a general discussion of the theory behind diamond patterning and disk shock fronts in supersonic gas jets, the readers attention is directed to, "The Air-Jet With A Velocity Exceeding That Of Sound", J. Harman et al., Philosophical Magazine, Vol. 31, page 35, 1939.

Obviously, numerous modifications and variations of the present invention are possible in light of the above teachings. For example, tests indicate that a 92% Cu - 8% Al melt at 1200 degrees centigrade may be substituted in the above powder making example. Other molten metals should work equally well. It is therefore to be understood that within the scope of the appended claims, the invention may be practiced otherwise than as specifically described.

What is claimed and desired to be secured by Letters Patent in the United States is:

1. A method for generating a supersonic spray of atomized metal droplets, employing a melt nozzle having an exterior surface portion in the shape of the frustrum of a cone with a melt tube orifice at the center of the nozzle and with a plurality of gas jets coaxial to the nozzle flowing over said exterior surface portion, comprising the steps of:

(a) liquifying metal and allowing it to flow into the melt tube orifice;

(b) positioning the respective gas jets over circularly-spaced portions of the exterior surface portion so that a vector describing the direction of each gas jet has a positive first component in the same direction as the direction of metal flow from the melt tube orifice and a positive second component perpendicular to the direction of metal flow from the melt tube orifice;

(c) establishing the input pressure to the gas jets at a pressure in excess of 1000 psig sufficient such that a pressure comes to exist at the melt tube orifice that is of smaller magnitude than that which exists when the gas jets are at zero input pressure; and, (d) adjusting the relative magnitudes of said first component and said second component of the gas jet direction vectors such that a spray having supersonic speed is produced.

2. The method of claim 1 comprising the further step of positioning the gas jets such that each of the gas jet direction vectors is parallel with the exterior surface portion of the cone congruent with the nozzle frustrum.

3. The method of claim 2 wherein the respective axis line of each gas jet is further positioned at a distance from the exterior nozzle cone surface substantially equal to the radius of the gas jet orifice.

4. The method of claim 1 wherein the respective axis line of each gas jet is positioned with respect to the inclined exterior surface of the nozzle frustrum such that substantially laminar as opposed to turbulent gas flow exits at said exterior surface.

5. The method of claim 4 wherein the respective axis line of each gas jet is further positioned at a distance from the said exterior nozzle cone surface substantially equal to the radius of the gas jet orifice.

6. The method of claim 5 wherein the said first and second components of the gas jet direction vectors are chosen such that the respective axis line of each gas jet intersects the axis line of the melt tube orifice at an intersection angle in the range of 0 to 25 degrees.

7. The method of claim 5 wherein the said first and second components of the gas jet direction vectors are chosen such that the respective axis line of each gas jet intersects the axis line of the melt tube orifice at an intersection angle in the range of 0 to 25 degrees.

8. The method of claim 5 wherein the said intersection angle is substantially 22.5 degrees.

9. The method of claim 8 wherein the gas inlet pressure is set at substantially 12.5 MPa (1800 psig.).

10. A method for generating a supersonic spray of atomized metal droplets, employing a nozzle having an exterior surface portion in the shape of the frustrum of a cone, with a melt tube orifice at the center of the nozzle, and with a plurality of gas jets coaxial to the nozzle, comprising the steps of:

(a) liquifying metal and allowing it to flow into the melt tube orifice;

(b) positioning the gas jet over circularly-spaced portions of the exterior surface portion so that a vector describing the direction of each gas jet has a positive first component in the same direction as the direction of metal flow from the melt tube orifice and a positive second component perpendicular to the direction of metal flow from the melt tube orifice;

(c) further positioning the respective gas jets such that each gas jet vector is parallel with the exterior surface of the cone congruent with the nozzle frustrum (d) further positioning the respective axis line of each gas jet at a distance from said exterior cone surface substantially equal to the radius of the gas jet orifice (e) further positioning the gas jets such that the intersection angle between the respective axis line of each gas jet and the axis line projecting from the melt tube orifice is substantially 22.5 degrees (f) establishing a gas inlet pressure to the coaxial gas jets in the range of 10MPa to 17.5 MPa; and (e) further adjusting the gas inlet pressure to the said gas jets such that a pressure is established at the melt tube orifice which is lower than that pressure which exists when the said gas inlet pressure is zero.

* * * * *